US007240735B2

(12) United States Patent
Crozier

(10) Patent No.: US 7,240,735 B2
(45) Date of Patent: Jul. 10, 2007

(54) SUBSEA WELLHEAD ASSEMBLY

(75) Inventor: Alistair D. Crozier, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 261 days.

(21) Appl. No.: 11/007,947

(22) Filed: Dec. 9, 2004

(65) Prior Publication Data

US 2005/0126788 A1 Jun. 16, 2005

Related U.S. Application Data

(60) Provisional application No. 60/528,417, filed on Dec. 10, 2003.

(51) Int. Cl.
*E21B 29/12* (2006.01)

(52) U.S. Cl. ..... 166/344; 166/242.6

(58) Field of Classification Search ..... 166/368, 166/344, 345, 242.6
See application file for complete search history.

(56) References Cited

U.S. PATENT DOCUMENTS

| | | | | |
|---|---|---|---|---|
| 3,850,237 | A | 11/1974 | Ahlstone et al. | |
| 4,696,493 | A | 9/1987 | Brammer | |
| 4,949,786 | A | 8/1990 | Eckert et al. | |
| 5,103,915 | A | 4/1992 | Sweeney et al. | |
| 5,566,761 | A | 10/1996 | Pallini, Jr. et al. | |
| 6,070,669 | A | 6/2000 | Radi et al. | |
| 6,234,252 | B1 | 5/2001 | Pallini, Jr. et al. | |
| 6,260,624 | B1 | 7/2001 | Pallini, Jr. et al. | |
| 6,450,507 | B2 * | 9/2002 | Johnson | 277/612 |
| 7,025,360 | B2 * | 4/2006 | Walker et al. | 277/652 |
| 7,107,662 | B1 * | 9/2006 | Levario | 29/505 |
| 2001/0001419 | A1 * | 5/2001 | Allen | 166/368 |
| 2001/0045286 | A1 * | 11/2001 | Pallini et al. | 166/345 |
| 2003/0000694 | A1 * | 1/2003 | Sweeney et al. | 166/115 |
| 2003/0066655 | A1 * | 4/2003 | Cook et al. | 166/380 |
| 2003/0094284 | A1 | 5/2003 | Fenton et al. | |
| 2003/0145996 | A1 * | 8/2003 | Singeetham et al. | 166/345 |
| 2004/0113426 | A1 * | 6/2004 | Milberger et al. | 285/330 |
| 2004/0159439 | A1 * | 8/2004 | Fenton et al. | 166/348 |
| 2004/0163818 | A1 * | 8/2004 | Fenton et al. | 166/368 |
| 2005/0051362 | A1 * | 3/2005 | McGuire et al. | 175/57 |
| 2006/0196677 | A1 * | 9/2006 | McGuire et al. | 166/379 |

FOREIGN PATENT DOCUMENTS

| | | |
|---|---|---|
| GB | 2107005 A | 4/1983 |
| GB | 2240564 A | 8/1991 |
| GB | 2292573 A | 2/1996 |

* cited by examiner

*Primary Examiner*—Thomas A Beach
(74) *Attorney, Agent, or Firm*—Bracewell & Giuliani LLP

(57) ABSTRACT

A subsea wellhead including a wellhead housing having a bore with a grooved profile. An upper portion of the bore has a greater diameter than a lower portion of the bore, and a central conical portion of the bore joins the upper portion of the bore and the lower portion of the bore. A connector body lands in the wellhead housing. The connector body has a conical section that interfaces with the central conical portion of the bore. A seal is secured between the central conical portion of the bore of the wellhead housing and the conical section of the connector body at the interface of the wellhead housing and the connector body. A locking element is carried on the connector body. The locking element has an outer side that engages the grooved profile of the wellhead housing.

19 Claims, 3 Drawing Sheets

SUBSEA WELLHEAD ASSEMBLY

RELATED APPLICATIONS

This application claims the benefit under 35 USC § 119(e) of U.S. Provisional Application Ser. No. 60/528,417, filed Dec. 10, 2003, which is herein incorporated by reference in its entirety.

FIELD OF THE INVENTION

This invention relates generally to a connector for subsea tubular members, and more particularly to a connector and seal assembly for connecting the connector to a subsea wellhead housing.

BACKGROUND OF THE INVENTION

A subsea well assembly undergoes several installation procedures, including drilling, completion, and production installation procedures. The subsea well assembly will have an outer or low pressure wellhead housing secured to a string of conductor pipe which extends some short depth into the well. An inner or high pressure wellhead housing lands in the outer wellhead housing. A drilling riser connector is connected to the inner high pressure wellhead housing. A casing hanger is installed in the wellhead housing, and the high pressure wellhead housing is secured to an outer string of casing, which extends through the conductor pipe to a deeper depth into the well, after which the casing is cemented. Depending on the particular conditions of the geology above the target zone, one or more additional casing strings will extend through the outer string of casing to increasing depths in the well until the well is to the final depth.

When the drilling operations are finished, the drilling riser connector is removed from the inner high pressure wellhead housing. In one type of subsea well, a tubing hanger is installed in the wellhead housing inside the casing, and a tubing string extends into the well for production. Then a production connector body carrying a production tree lands on the high pressure wellhead housing in communication with the tubing hanger.

In prior versions of subsea wells, a metal seal ring seals between the high pressure wellhead housing and the production tree at the rim of the high pressure wellhead housing. This results in a fairly large diameter seal ring, which can be difficult to achieve at high pressure ratios.

SUMMARY

The invention provides a subsea wellhead including a wellhead housing having a bore with a grooved profile. An upper portion of the bore has a greater diameter than a lower portion of the bore, and a central conical portion of the bore joins the upper portion of the bore and the lower portion of the bore. A connector body lands in the wellhead housing. The connector body has a conical section that interfaces with the central conical portion of the bore. A seal is secured between the central conical portion of the bore of the wellhead housing and the conical section of the connector body at the interface of the wellhead housing and the connector body. A locking element is carried on the connector body. The locking element has an outer side that engages the grooved profile of the wellhead housing.

DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
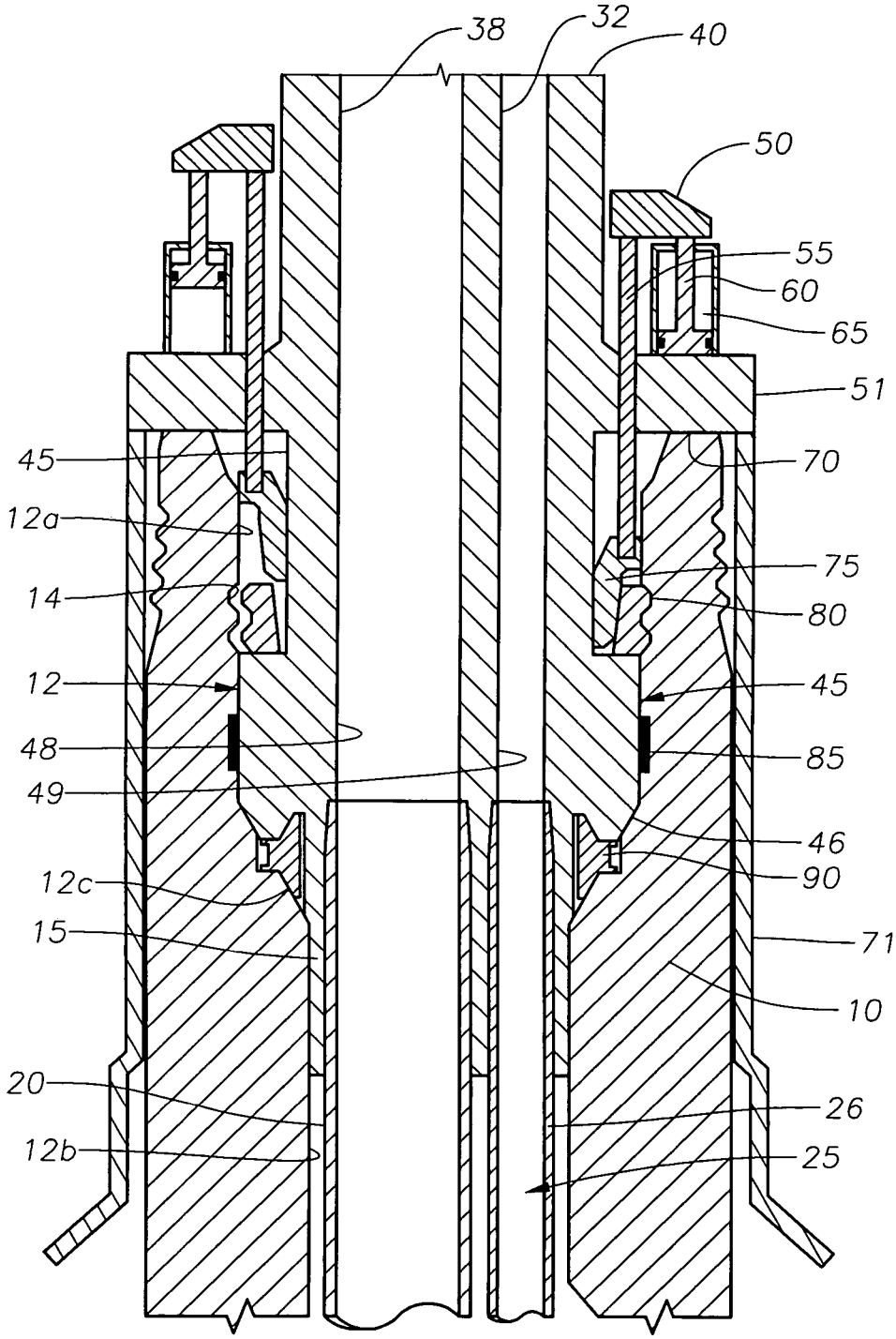
FIG. 1 shows a schematic sectional view of a subsea wellhead assembly, featuring a left side quarter-sectional in a first position and a right side quarter-sectional in a second position.

FIG. 1 shows a sectional view of a subsea wellhead assembly, featuring a left side quarter-sectional view in a first position, and a right side quarter-sectional view in a second position. High pressure wellhead housing 10 is in a landed position in the wellhead assembly. Wellhead housing 10 has a bore 12 containing a grooved profile 14. The upper portion 12*a* of bore 12 is larger in diameter than the lower portion 12*b* of bore 12. A central conical portion 12*c* of the bore extends between and joins the upper portion 12*a* and lower portion 12*b*. At least one casing hanger 120 will be landed in wellhead housing 10 for supporting a string of casing that is cemented in the well.

A tubing hanger 15 is landed in lower bore section 12*b* of high pressure wellhead housing 10 and supports a string of tubing 20 extending within the casing into the well. The well will produce fluids through tubing 20. A tubing annulus 25 exists between tubing 20 and high pressure wellhead housing 10. A tubing annulus conduit 26 communicates with tubing annulus 25 and is supported by tubing hanger 15. Tubing annulus conduit 26 is offset from and smaller in diameter than production tubing 20.

Referring to FIG. 1, a connector body 45 lands in the wellhead housing 10. A connector body 45 is secured to or includes the lower end of a production tree 40 (only partially shown) for connecting tree 40 to wellhead housing 10. Connector body 45 has a conical section 46 that lands in the central conical portion 12*c* of the bore 12 and interfaces with central conical portion 12*c*. Connector body 45 has receptacles on its lower end that sealingly mate with conduits 20 and 26 in tubing hanger 15. Passages 48 and 49 extend through connector body 45 and register with tubing annulus bore 32 and production bore 38 in tree 40. A sealed passage thus extends from tubing 20 to production bore 38. Another sealed passage extends from tubing annulus 25 to tubing annulus bore 32 in tree 40.

Connector body 45 includes a flange 51 that lands on the rim 70 of high pressure wellhead housing 10. A downward facing cylindrical sleeve 71 extends downward from flange 51 for close sliding reception on wellhead housing 10. Several hydraulic cylinders 65 are mounted to the upper side of flange 51. Each hydraulic cylinder 65 has a piston 60 inside the cylinder, which connects to an actuator ring 50.

Several rods 55 or shafts 55 connect to a portion of actuator ring 50 radially inward from piston 60. Rods 55 or shafts 55 extend downward through holes in flange 51.

Rods 55 connect actuator ring 50 to an axially moveable internal cam ring 75 located within the bore of wellhead housing 10. Cam ring 75 optionally may be split for assembly to connector body 45, because the loads on cam ring 75 result in mainly radial and hoop compressive stresses. In a first position, the lower end of cam ring 75 abuts an upper end of a locking element 80, as shown on left side quarter-sectional view of FIG. 1. The locking element 80 is carried on an upward facing shoulder of the connector body. Locking element 80 preferably comprise a split ring, but can also comprise separate dogs, a C-ring, or other such element. Locking element 80 has an outer side with a profile that engages mating groove 14. The locking element 80 is designed to expand over the lower portion of connector body 45 for assembly.

The inside radial surface of cam ring 75 is generally vertical against connector body 45. The outer radial surface of cam ring 75 has is tapered, and engages or abuts an inner tapered surface of locking element 80. The lobes of the profile on locking element 80 prior to engagement-are slightly above and misaligned with profile grooves 14 on upper portion of the high pressure wellhead housing 10, but after engagement locking element 80 entirely interfaces profile grooves 14.

A seal 90, such as a preloaded 13⅝" metal sealing gasket, is located between high pressure wellhead housing 10 and connector body 45 to prevent fluid from passing on the exterior of connector body 45. Seal 90 is installed at the interface of the wellhead housing 10 and the connector body 45. As shown in FIG. 1, the seal 90 is fit between the central conical portion 12*c* of the bore 12 of the wellhead housing 10 and the conical section 46 of the connector body 45. An optional elastomeric back-up seal 85, such as a preloaded parallel bore metal seal, optionally may be vertically fit between the interface of the upper section of the connector body 45 and the upper portion of wellhead housing 10. The elastomeric seal 85 operates as a back-up to seal 90.

Figure 2:
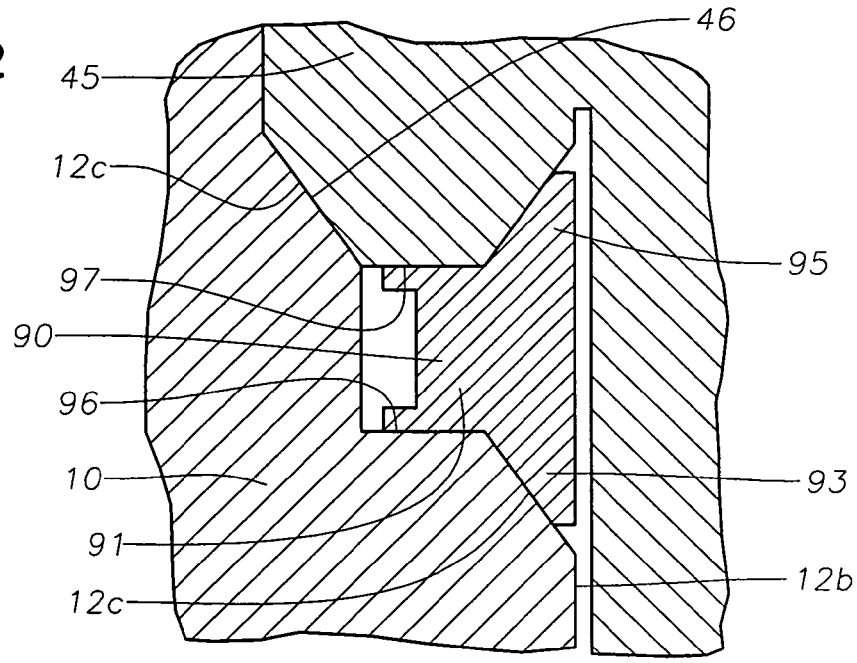
FIG. 2 shows an enlarged view of a seal of the wellhead assembly of FIG. 1.

Referring to FIG. 2, one embodiment of a seal 90 shown in FIG. 1 has a radially outward protruding rib 91 and a pair of conical legs 93, 95 extending in substantially opposite directions. Each of the conical legs 93, 95 has a conical sealing surface. The outer conical surface of leg 95 interfaces and seals against a conical portion of the connector body 45. The outer conical surface of leg 93 interfaces and seals against the conical portion 12*c* of the bore 12 of wellhead housing 10. The lower side of rib 91 lands on an upward facing shoulder 96 indented within bore section 12*c* of the wellhead housing 10. The upper side of rib 91 fits against a downward facing shoulder 97 of the connector body 45. The inner diameter of seal 90 is approximately the same as the diameter of lower bore section 12*b*. A retainer (not shown) retains seal 90 with connector body 45 while connector body 45 is being lowered into bore 12.

Figure 3:
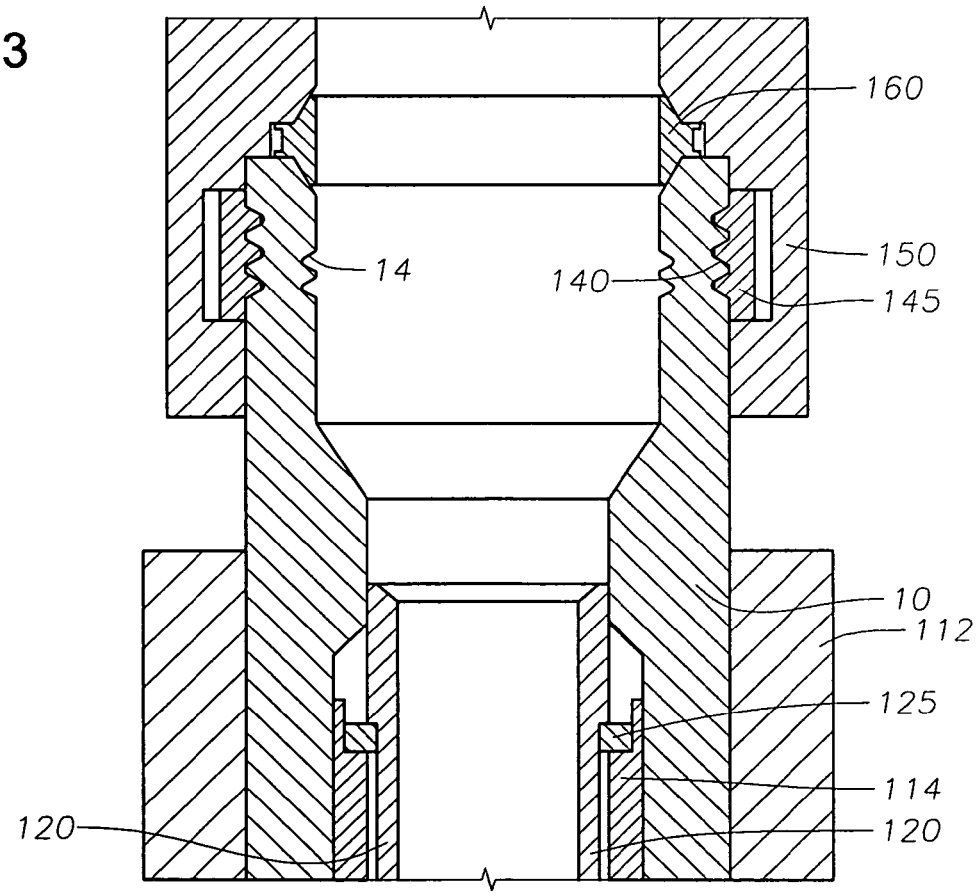
FIG. 3 shows a schematic sectional view of the subsea wellhead housing of FIG. 1, but shown connected to a drilling riser connector.

FIG. 3 shows the wellhead assembly of FIG. 1 during drilling operations. The inner high pressure wellhead housing 10 lands in an the outer low pressure wellhead housing 112, which is not shown in FIG. 1. A drilling riser connector body 150 is located on the inner wellhead housing 10. When the drilling riser connector body 150 is landed on the wellhead housing 10, locking element 145, similar to locking element 80 illustrated in FIG. 1, engages an outer grooved profile 140 on the outer side of the wellhead housing 10. At least one casing hanger 120 is landed in wellhead housing 10 for supporting a string of casing that is cemented in the well. The casing hanger 120 is supported by a shoulder ring 125 that is supported by a support ring 114. Shoulder ring 125 moves axially downward from a recessed position when running casing hanger 120. Other load shoulders are feasible, including stationary structures and other suitable structures.

The inner wellhead housing 10 has a rim 170 and a conical surface 155 joining the rim 170. When the drilling connector body 150 is landed on the inner wellhead housing 10, a metal seal 160 is installed between the conical portion 155 of the wellhead housing 10 and a conical portion 165 of the connector body 150. Seal 160 is similar to seal 90 (FIG. 2) except that it is somewhat larger in diameter.

Figure 4:
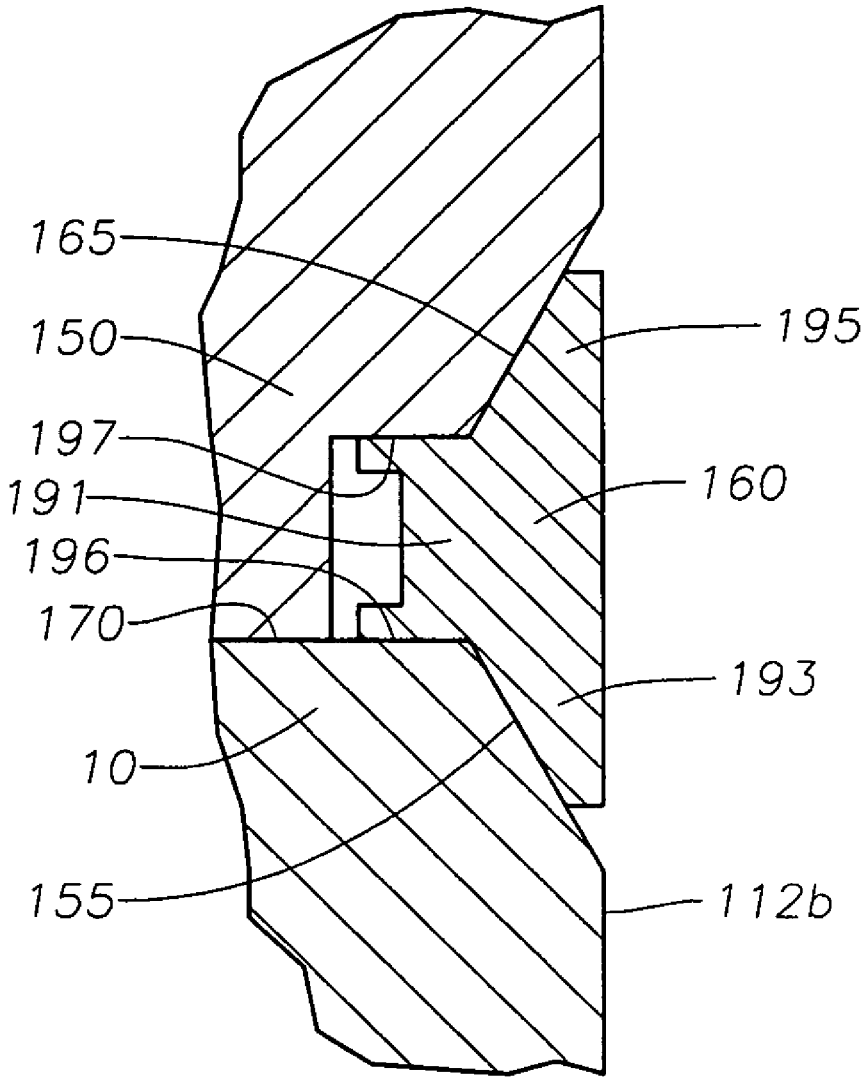
FIG. 4 shows an enlarged view of a seal of the wellhead assembly of FIG. 3.

Referring to FIG. 4, seal 160 has a rib 191 and a pair of conical legs 193, 195 extending in substantially opposite directions. Each of the conical legs 193, 195 has a conical sealing surface. The outer conical surface of leg 193 interfaces and seals against the conical surface 155 of wellhead housing 10 that joins the rim 170 of the wellhead housing 10. The outer conical surface of leg 195 interfaces and seals against the conical surface 165 of the connector body 150. The lower side of the rib 191 lands on the upward facing rim 170 of the wellhead housing 10. The upper side of the rib 191 fits against a downward facing shoulder of the connector body 150. The inner diameter of the seal 190 is approximately the same as the inner diameter the upper portion of wellhead housing 10. A retainer (not shown) retains seal 190 with connector body 150 while connector body 150 is being landed onto the wellhead housing 10.

In operation, the inner or high pressure wellhead housing 10 lands in the outer wellhead housing 112. The drilling riser connector body 150 and drilling riser (not shown) are lowered with the inner high pressure wellhead housing 10. The seal 160 is carried by the drilling riser connector body 150, and interfaces the wellhead housing 10 and the connector body 150. The high pressure wellhead housing 10 is secured to an outer string of casing, which extends through the conductor pipe to a deeper depth into the well, after which the casing is cemented. Depending on the particular conditions of the geology above the target zone, one or more casing strings will extend through the outer string of casing to increasing depths in the well until the well is to the final depth.

When the drilling operations are finished, the drilling riser connector body 150 is removed from the inner high pressure wellhead housing 10 along with metal seal 160. A tubing hanger 15 is installed in the wellhead housing 10 inside the casing 120, and a tubing string extends into the well for production. A production connector body 45 is attached to the lower end of production tree 40 and lowered into the sea, whereby the production connector body 45 is landed in the wellhead housing 10. Seal 90 will be carried on connector body 45, and interfaces the wellhead housing 10 and the connector body 45 when installed or fit in its proper position. Connector body 45 lands on conical bore section 12*c*, and passages 48 and 49 sealingly mate with conduits 20 and 26, respectively. Sleeve 71 slides over wellhead housing 10. Connector body 45 will be in a first position with piston 60 in its upper position, as shown in left side quarter-sectional view in FIG. 1.

Then hydraulic fluid pressure is supplied to move pistons 60. As pistons 60 move downward, rods 55 push cam ring 75 vertically downward accordingly. As the tapered chamfer on cam ring 75 is driven down, it applies a force against locking element 80, whereby the force has components directed both vertically downward and radially outward against locking element 80. The force pushes locking element 80 from the initial position misaligned with the groove 14 on the upper portion of the wellhead housing 10 to a position whereby the profiles of both locking element 80 and groove 14 interface and firmly lock in place.

Another resultant force from the aforementioned hydraulic cylinder operation is the force provided from the locking element 80 against a downward facing shoulder of groove 14. As cam ring 75 applies a force against locking element 80, locking element 80 in turn applies a downward force against connector body 45, causing connector body 45 to move vertically downward a slight amount. Flange 51 preloads against the upper portion of wellhead housing 10. Connector body 45 preloads against seal 90, which in turn is forced against bore section 12*c*. The downward movement causes seal 90 to form a metal-to-metal seal with bore section 12*c*.

In this invention, the connector body provides structural and pressure connection to the subsea wellhead. An important advantage of this invention is that the connector body has a small outer diameter, which compliments other advantages of the connector body such as light weight and low bending capacity. The metal seal ring is considerably smaller in diameter than the prior art metal seal ring, enabling it to more easily seal against high pressure.

Although some embodiments of the present invention have been described in detail, it should be understood that various changes, substitutions, and alterations can be made hereupon without departing from the principle and scope of the invention. Accordingly, the scope of the present invention should be determined by the following claims and their appropriate legal equivalents.

The invention claimed is:

1. A subsea wellhead assembly comprising:

a wellhead housing comprising a bore with a grooved profile in the bore, an upper portion of the bore having a greater diameter than a lower portion of the bore, and a central conical portion of the bore joining the upper portion of the bore and the lower portion of the bore, the central conical portion of the bore being below the grooved profile;

a connector body having a lower portion that extends into the wellhead housing, the lower portion of the connector body having a seal section;

a seal secured between the central conical portion of the bore of the wellhead housing and the seal section of the connector body; and a locking element carried on the connector body, the locking element having an outer side that engages the grooved profile of the wellhead housing.

2. The assembly of claim 1, wherein the seal comprises a metal sealing gasket.

3. The assembly of claim 1, wherein the seal has a pair of conical legs extending in substantially opposite directions, each of the legs having a conical sealing surface.

4. The assembly of claim 3, wherein the seal has a radially outward protruding rib that locates between a shoulder of the connector body and a shoulder of the wellhead housing.

5. The assembly of claim 1, wherein:

the lower portion of the connector body has a conical portion that faces downward and outward, relative to an axis of the wellhead housing, and a conical seal surface that faces downward and inward; and the central conical portion of the bore faces upward and inward and has a conical seal surface that faces upward and inward.

6. The assembly of claim 1, further comprising an elastomeric back-up seal fit between a cylindrical section of the connector body and the upper portion of the wellhead housing.

7. The assembly of claim 1, further comprising an axially movable cam ring having a tapered outer side that abuts a tapered inner side of the locking element and having an inner side interfacing with an outer side of the connector body to cause the locking element to engage the grooved profile.

8. The assembly of claim 1, wherein the locking element is carried on an upward facing shoulder of the connector body.

9. The assembly of claim 1, wherein the connector body further comprises a flange that lands on a rim of the wellhead housing.

10. The assembly of claim 1, wherein the connector body comprises a lower portion of a production tree assembly, and the assembly further comprises a tubing hanger landed in the wellhead housing below the connector body.

11. The assembly of claim 1, wherein the wellhead housing has a rim and a conical seal surface joining the rim for receiving a drilling riser connector seal ring, the grooved profile in the bore being located between the conical seal surface and the central conical portion in the bore.

12. A subsea wellhead assembly comprising:

a wellhead housing comprising a bore with a grooved profile in the bore, an upper portion of the bore having a greater diameter than a lower portion of the bore, and a central conical portion of the bore joining the upper portion of the bore and the lower portion of the bore, the central conical portion being below the grooved profile;

a connector body having a flange that lands on an upper end of the wellhead housing and a lower portion that inserts into the bore of the wellhead housing, the lower portion of the connector body having a conical section that lands on the central conical portion of the bore;

a metal seal secured between the central conical portion of the bore of the wellhead housing and a conical seal surface of the connector body, wherein the seal has a pair of conical legs extending in substantially opposite directions, each of the conical legs having a conical sealing surface that prevents fluid in the bore from passing to the exterior of the connector body; and a locking element carried on the connector body, the locking element having an outer side that engages the grooved profile of the wellhead housing.

13. The assembly of claim 12, wherein:

the conical section of the connector body faces downward and outward, relative to an axis of the wellhead housing, and the conical seal surface of the connector body faces downward and inward; and the central conical portion of the bore faces upward and inward and has a conical seal surface that faces upward and inward.

14. The assembly of claim 12, further comprising:

a cam ring having a tapered outer side that abuts a tapered inner side of the locking element and having an inner side interfacing with an outer side of the connector body; and a hydraulic cylinder in structural communication with the cam ring and operative to force the tapered outer side of the cam ring along the tapered inner side of the locking element, thereby forcing the outer side of the locking element into engagement with the grooved profile of the wellhead housing.

15. The assembly of claim 12, wherein the connector body comprises a lower portion of a production tree assembly, and the assembly further comprises:

a tubing hanger landed in the wellhead housing below the connector body.

16. The assembly of claim 12, wherein the wellhead housing has a rim and a conical seal surface joining the rim for receiving a drilling riser connector seal ring, the grooved profile being located between the conical seal surface and the central conical portion in the bore.

17. A method of installing a subsea wellhead assembly comprising:

(a) providing a wellhead housing having a bore containing an internal grooved profile and a central conical portion below the grooved profile;

(b) providing a connector body with a locking element, inserting a lower portion of the connector body into the bore of the wellhead housing, and sealing between the lower portion of the connector body and the central conical portion of the bore; and (c) moving the locking element into engagement with the grooved profile of the wellhead housing.

18. The method of claim 17, further comprising:

wherein step (a) further comprises providing the wellhead housing with a rim and a conical surface joining the rim; and prior to step (b) and step (c), drilling the well by connecting a drilling riser connector body to the wellhead housing, installing a metal seal having a pair of conical sealing surfaces between the wellhead housing and the drilling riser connector body, interfacing the conical sealing surfaces of the metal seal with the conical surface of the wellhead housing and a conical surface of the drilling connector body, installing casing in the wellhead housing, removing the drilling riser connector body, and then performing step (b) and step (c).

19. The method of claim 17, wherein the connector body comprises a lower portion of a production tree assembly, and the method further comprises landing a tubing hanger in the wellhead housing prior to inserting a lower portion of the connector body into the bore of the wellhead housing.

* * * * *